US005735333A

United States Patent [19]

Nagawa

[11] Patent Number: 5,735,333

[45] Date of Patent: Apr. 7, 1998

[54] LOW-MELTING-POINT METAL MATERIAL INJECTION MOLDING METHOD, AND MACHINE FOR PRACTICING THE METHOD

[75] Inventor: Ayato Nagawa, Hiroshima, Japan

[73] Assignee: The Japan Steel Works, Ltd., Tokyo, Japan

[21] Appl. No.: 654,870

[22] Filed: May 29, 1996

[30] Foreign Application Priority Data

May 29, 1995 [JP] Japan ..... 7-152789

[51] Int. Cl.[6] ..... B22D 17/10; B22D 17/20

[52] U.S. Cl. ..... 164/113; 164/312

[58] Field of Search ..... 164/113, 312, 164/314

[56] References Cited

U.S. PATENT DOCUMENTS 5,040,589 8/1991 Bradley et al. .

5,167,896 12/1992 Hirota et al. ..... 264/255

FOREIGN PATENT DOCUMENTS 3639737 6/1988 Germany ..... 164/312

4-231161 8/1992 Japan ..... 164/312

*Primary Examiner*—Joseph J. Hail, III

*Assistant Examiner*—I.-H. Lin

*Attorney, Agent, or Firm*—Sughrue, Mion, Zinn, Macpeak & Seas, PLLC

[57] ABSTRACT

An injection molding machine includes a pair of injecting units. In each of the cylinder barrels of the injection units, a metal element having a melting point of 650° C. or lower, or an alloy of such metal element is melted and measured by using heat which is externally applied thereto, and frictional heat, and shearing heat which are produced when the screw in the cylinder barrel is driven.

7 Claims, 2 Drawing Sheets

LOW-MELTING-POINT METAL MATERIAL INJECTION MOLDING METHOD, AND MACHINE FOR PRACTICING THE METHOD

BACKGROUND OF THE INVENTION

1. Field of the Invention

This invention relates to a method of injection-molding a low-melting-point metal material in which an injecting machine is used which comprises a cylinder barrel and a screw which is rotated and axially driven, where the low-melting-point metal material is melted and measured, and is injected into a metal mold to obtain a desired molding, and to an injection-molding machine for practicing the method.

2. Related Art

Typical examples of a metal molding method are a pressure casting method in which a mechanical pressurizing means is employed, and a gravity casting method in which the use of pressurizing means is not particularly required. A typical example of the pressure casting method is a die casting method. This method is applied to production of alloys of low-melting-point metal materials such as aluminum, magnesium, and zinc. In addition, an injection molding method is also proposed for formation of such moldings.

A typical example of an injection molding machine for practicing the injection molding method of the invention is an in-line screw type injection molding machine which is well known in the art (requiring no citation of its concerned literature). It is made up of a cylinder barrel, a screw which is turned and axially driven in the cylinder barrel, and a drive device for turning and axially driving the screw. In this injection molding machine, while the screw is being turned by the drive device, an injection material such as a low-melting-point metal material is supplied from the hopper into the cylinder barrel. The injection material thus supplied is kneaded and melted by the frictional force and shearing force due to the rotation of the screw and by the heat externally applied thereto. The material thus treated is moved towards the front part of the cylinder barrel, so that a predetermined quantity of injection material is stored therein.

As the screw is driven in the axial direction, the metal material stored in the cylinder barrel is injected through the nozzle at the end of the cylinder barrel and through the sprue of the clamped metal mold, and through the runner and the gate into the cavity, thus being formed into a metal molding.

It is true that the above-described conventional injection molding machine is able to provide a metal molding high in quality owing to the specific features of the injection molding method. However, the conventional injection molding machine suffers from the following problem in the case where it is required to form a molding which is 5000 cc or more in injection volume. That is, the molten metal material solidifies very quickly, and therefore, in the metal mold, the material is limited in its length of flow, and accordingly, in order to obtain a large molding, it is necessary to provide a plurality of gates.

In the case where a plurality of gates are provided, the runner from the sprue to the gate must have a branch. The metal material in the runner extending from the sprue to the gate is cut off after molding; that is, it is waste material when a produced molding is compared with the metal material used for formation of the molding. That is, the quantity of the unwanted waste material is increased when compared with the produced moldings, which increases the manufacturing cost.

In addition, in the case of a molding machine for forming a large molding, its heating means presents a problem to be solved. That is, a heating element made up of a resistance heater is provided around the cylinder barrel, so that the low-melting-point metal material is heated by the heating element when measured. In order to melt the low-melting-point metal material, it is necessary to use a great amount of thermal energy. On the other hand, the capacity per unitary area of the resistance heater is naturally limited to a certain value with its service life taken into consideration, and in order to increase its melting capacity, it is essential to increase the absolute value of capacity of the resistance heater. For this purpose, it is necessary to increase the surface area of the heating element; that is, it is necessary to increase the outside diameter of the resistance heater more than required for its sufficient mechanical strength and function, which is not economical. A low-melting-point metal material must be supplied at an extremely high speed, for instance 0.02 second. Hence, in order to accomplish the injection of a large quantity of metal material within such a short time, it is necessary to use a considerably bulky injecting device. That means that the molding machine itself is high in manufacturing cost.

In view of the foregoing, an object of the invention is to eliminate the above-described difficulties accompanying a conventional injection-molding method or machine. More specifically, an object of the invention is to provide a low-melting-point metal material injection-molding method which is able to form a large molding at low cost, and an injection molding machine for practicing the method.

The present invention employs two injection molding machines. The reason is that the cost for manufacturing one large injection molding machine is higher than that of two small injection molding machines. Further, in the case where a predetermined amount of the molten metal is injected in a predetermined time period, the size of a runner produced by two nozzles is smaller than an amount of a runner produced by one nozzle.

The foregoing object of the invention has been achieved by a method of injection-molding a low-melting-point metal material in which a solid low-melting-point metal material in a cylinder barrel of an injecting unit is melted and measured by using heat which is externally applied thereto, and frictional heat and shearing heat which are produced when a screw in the cylinder barrel is driven, and the screw is driven axially to inject the low-melting-point metal material into a metal mold, to obtain a low-melting-point metal molding, in which, according to an aspect of the invention, two injecting units are employed, in each of the two injecting units, the low-melting-point metal material is measured up to a predetermined quantity, and the metal materials thus measured are injected into one cavity from the injecting units.

In the method of the present inventon, the low-melting-point metal material is one selected from a group of metal element simple substances whose melting point is 650° C. or lower or alloys which essentially contain at least one of the metal element simple substances. Furthermore, in the method of the present invention, the total volume of the low-melting-point metal materials measured by the two injecting units is 5000 cc or more.

An injection molding machine of the present invention injects a low-melting-point metal material into a metal mold in which two nozzle inserting holes formed in a stationary board are communicated with one cavity through at least two sprues; in which, according to another aspect of the invention, the machine comprises a pair of injecting units which include:

cylinder barrels having injecting nozzles at the front ends thereof;

screws provided in the cylinder barrels in such a manner that the screws are rotated and axially driven; and driving means for rotating and axially driving the screws, the pair of injecting units being set on injecting-unit supporting stands which are driven towards and away from the stationary board, in such a manner that the injecting units are extended in parallel with each other.

In the machine of the present invention, the injecting-unit supporting stands are fixedly mounted on a swing member which is swingable about a swing pin thereof.

As is well known in the art, the screws in one pair of injecting units are driven to measure the low-melting-point metal materials up to predetermined values. The pair of injecting units are driven towards the stationary board, so that the injecting nozzles of the injecting units are inserted into two nozzle inserting holes formed in the stationary board, or the swing member is swung, to align the pair of injecting nozzles with the two nozzle inserting holes, thus touching the metal mold.

Next, in the pair of injecting units, the screws are turned to inject the metal material into one cavity of the clamped metal mold through at least two runners. In this case, the speeds of the screws are so adjusted that the low-melting-point metal materials in the pair of injecting units are injected into the metal mold substantially at the same time. After being held under a pressure for a certain period of time, the metal mold is opened to take the resultant metal molding out of it. The above-described operations are repeatedly carried out for formation of low-melting-point metal moldings.

DETAILED DESCRIPTION OF THE PREFERRED EMBODIMENTS

The invention will be described with reference to its preferred embodiment shown in the accompanying drawings.

Figure 1:
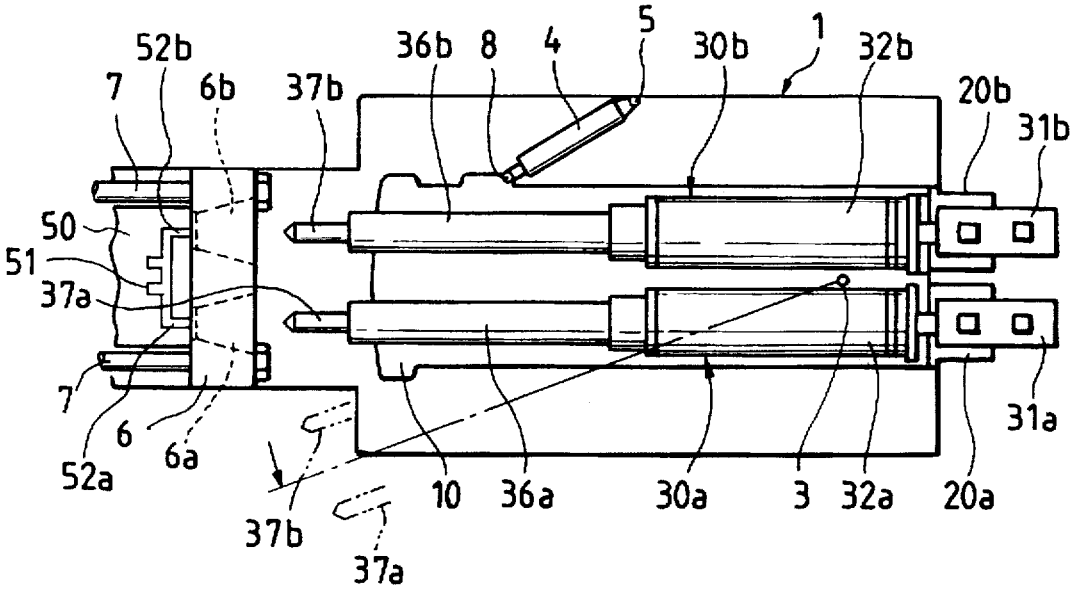
FIG. 1 is a cutaway plan view showing an example of an injection molding machine which constitutes an embodiment of the invention.
Figure 2:
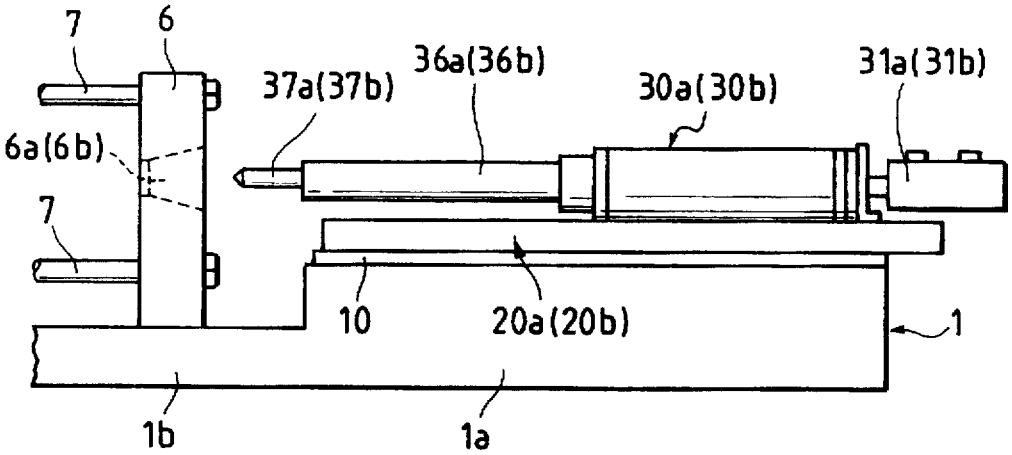
FIG. 2 is a side view of the injection molding machine shown in FIG. 1.
Figure 3:
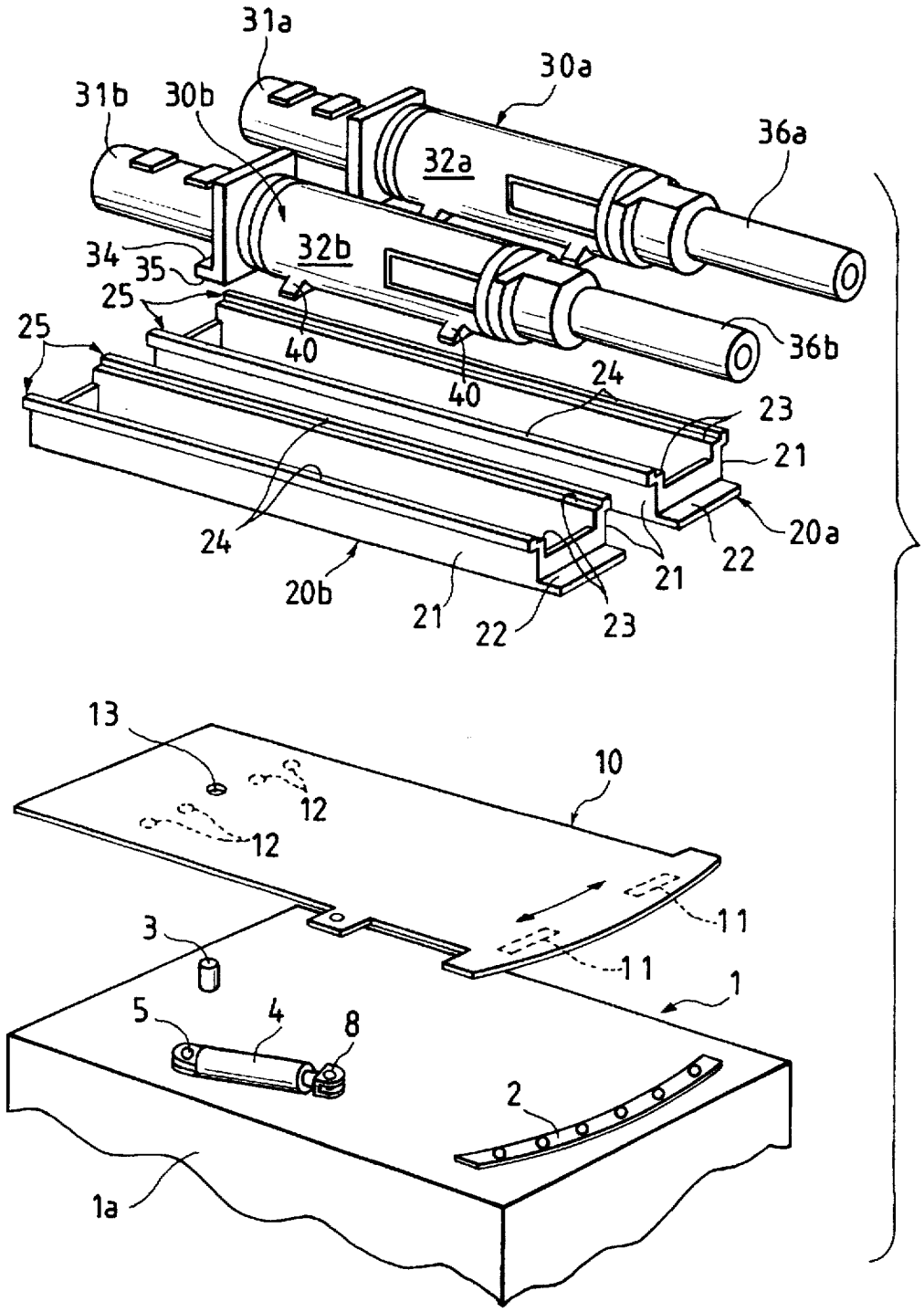
FIG. 3 is an exploded perspective view of the injection molding machine shown in FIG. 1.

FIG. 1 is a plan view, with parts cut away, showing a low-melting-point metal material injection molding machine, which constitutes the embodiment of the invention. FIG. 2 is a side view of the injection molding machine shown in FIG. 1. FIG. 3 is an exploded perspective view of the embodiment. The injection molding machine of the invention, as shown in those figures, comprises: an injecting bed 1; a swing board 10 which is swingably provided over the injecting bed 1; a pair of injecting unit supporting stands 20*a* and 20*b* which are fixedly mounted on the swing board 10 in such a manner that they are longitudinally extended in parallel with each other; and injecting units 30*a* and 30*b* provided on the supporting stands 20*a* and 20*b* in such a manner that they are freely axially slidable.

The injecting bed 1 is made up of first and second bed sections 1*a* and 1*b*. As is best shown in FIGS. 1 and 2, the first bed section 1*a* is located on the right side, and the second bed section 1*b* is on the left side, and the former 1*a* is larger in thickness than the latter 1*b*. As shown in FIG. 3, an arcuate slide rail 2 is laid on the upper surface of the front end portion of the first bed section 1*a* in such a manner that the slide rail 2 is extended laterally, and a swing pin 3 is embedded in the rear end portion of the first bed section 1*a* substantially at the center. In addition, a member 5 for receiving the rear end of a fluid cylinder 4 (hereinafter referred to as "a receiving member 5", when applicable) is pivotally mounted beside the pin 3.

As shown in FIGS. 1 and 2, a stationary board 6 is mounted on the second bed section 1*b*, and it has a pair of nozzle inserting holes 6*a* and 6*b* which are tapered toward the front of the bed 1. Those nozzle inserting holes 6*a* and 6*b* are communicated through the sprues 52*a* and 52*b* of a stationary metal mold 50 with one cavity 51 in the metal mold 50. The end portions of tie bars 7 are secured to the stationary board 6.

The swing board 10 is substantially rectangular similarly as in the case of the first bed section 1*a*, and has slide shoes 11 on the lower surface of its front end portion in correspondence to the slide rail 2 (hereinafter referred to as "front slide shoes 11", when applicable), and a plurality of slide shoes 12 on the lower surface of its rear end portion (hereinafter referred to as "rear slide shoes 12", when applicable). The slide rail 2, as shown best in the perspective view of FIG. 3, is protruded upwardly from the upper surface of the first bed section 1*a*. The slide shoes 12 of the swing board 10 are protruded downwardly from the lower surface of the swing board 10 (not accurately shown). Hence, the swing board 10 is held horizontal over the first bed section 1*a*. Therefore, when, with the swing pin 3 of the first bed section 1*a* positioned at a through-hole 13 formed in the swing board 10, the latter 10 is placed over the first bed section 1*a*, the front slide shoes 11 of the swing board 10 are supported on the slide rail 2 while the rear slide shoes 12 are supported on the upper surface of the swing board 10 in such a manner that the latter 10 is swingable about the swing pin 3.

In order to swing the swing board 10, the pin receiving member 8 of the piston rod of a fluid cylinder 4 is pivotally mounted beside the swing board 10.

The first injecting unit supporting stand 20*a* is similar in structure to the second injecting unit supporting stand 20*b*, and the first injecting unit 30*a* is also equal in structure to the second injecting unit 30*b*. Hence, the second injecting unit supporting stand 20*b* and the second injecting unit 30*b*, which are shown well in FIG. 3, will be described as typical examples (in other words, the description of the first injecting unit supporting stand 20*a* and the first injecting unit 30*a* will be omitted; that is, as for the first injecting unit supporting stand 20*a* and the first injecting unit 30*a*, it the description of the second injecting unit supporting stand 20*b* and the second injecting unit 30*b* can be read with the suffix letter "b" of each of the reference numerals of their relevant components replaced with the suffix letter "a").

The second injecting unit supporting stand 20*b* is substantially in the form of a trough made up of a pair of side walls 21 which are spaced a predetermined distance from each other, and a bottom wall 22 between the side walls 21. The bottom wall 22 is fixedly mounted on the swing board 10. The upper edge portion of one of the side walls 21 is formed into an angle-steel-shaped guide rail 25 which is made up of a horizontal supporting surface 23, and a vertical guide surface 24 which is extended upwardly from the outside of the supporting edge 23. The upper edge portion of the other side wall 21 is also formed into an angle-steel-shaped guide rail 25, in such a manner that its vertical guide surface 24 is confronted with the vertical guide surface 24 of the aforementioned one side wall 21.

The first injecting unit **30*b*, as is well known in the art, is made up of a cylinder barrel, a screw which is turned, and moved axially in the cylinder barrel, and drive devices 31*b* and 32*b*** adapted to turn and axially move the screw.

A heating element, namely, a heating cylinder **36*b* in FIG. 3, is provided around the cylinder barrel. An injecting nozzle 37*b* is provided at the end of the heating cylinder 36*b***. The screw employed is made up of a supply section, compression section, and storage section. The compression ratio of the screw; that is, the ratio of the groove space volume of the supply section to that of the storage section is set in a range of from 1.0 to 2.0. With a screw of a compression ratio of 1; that is, even with a screw which does not compress, the above-described low-melting-point metal material can be melted. If, on the other hand, the compression ratio exceeds 2.0, then the torque needed for pressing the metal material is excessively great. Hence, the resistance in moving the metal material forward becomes excessively high; that is, a "closed" state arises. It has been found through experiments that the most suitable compression ratio is in a range of from 1.2 to 1.8.

The aforementioned drive device **31*b* is made up of a hydraulic motor or the like to rotate the screw, and the drive device 32*b* is made up of a hydraulic piston/cylinder mechanism to drive the screw axially. Below the drive device 32*b*, a pair of slide members 40 are provided in such a manner that they are protruded outwardly and are spaced a predetermined distance from each other. Those slide members 40 are also guided by the guide rails 25 of the injection unit supporting stand 20*b***.

The cylinder barrel has a relatively long nozzle **37*b* at the end which is inserted into the nozzle inserting hole 6*b* of the stationary board 6**.

An injection molding method of forming a low-melting-point metal molding by using the above-described first and second injecting units **30*a* and 30*b***, will be described.

The term "low-melting-point metal material" as used herein is intended to mean metal element simple substances which are 650° C. or lower in melting point, or alloys essentially containing any one or ones of those metals. Examples of the low-melting-point metal materials are aluminum, magnesium, zinc, tin, lead, bismuth, terbium, tellurium, cadmium, thallium, astatine, polonium, selenium, lithium, indium, sodium, potassium, rubidium, cesium, francium, and gallium. It is preferable to employ simple substances such as aluminum, magnesium, lead, zinc, bismuth, and tin, or alloys essentially containing those metals. Those metal materials are all metal elements or alloys which can be kneaded, melted, and molded with an injection molding machine such as for instance an in-line screw type injection molding machine.

Those metal materials can be obtained in a variety of methods. For instance, they can be formed by chipping ingots with a chipping machine, or may be obtained as chips which are formed when they are cut with a cutting machine. In addition, the metal materials can be formed by dropping a molten metal into a cooling agent such as water. The metal materials thus obtained are suitably small in size, and, unlike powder, can be handled with ease. They are readily melted while being forwarded in the cylinder barrels.

In addition, those metal materials can be obtained according to the conventional reduction method or rotational consumable electrode method.

A low-melting-point metal material prepared in the above-described manner is stored, for instance, in a hopper, and the feed screw is turned, so that the metal material is supplied into the cylinder barrels of the first and second injecting units **30*a* and 30*b*. The drive devices 31*a* and 31*b*** turn the screws to measure the metal material. For instance, in the case where it is required to obtain a molding of 5000 cc, each of the injecting units should measure 2500 cc. However, in the case where the aimed molding is not symmetrical; for instance, it includes its portions different in wall thickness, or in the case where the distances to the runners are not equal, the measurement of the metal material at the injecting units should be adjusted according to those differences.

The drive devices (not shown) are activated to slide the injecting units **30*a* and 30*b* forwardly on the injecting units supporting stands 20*a* and 20*b* until the injecting nozzles 37*a* and 37*b* are inserted into the nozzle inserting holes 6*a* and 6*b* of the stationary board 6, thus touching the metal mold 50. In this case, the swing board 10 is swing about the swing pin 3 by the fluid cylinder 4, to align the injecting nozzles 37*a* and 37*b* with the nozzle inserting holes 6*a* and 6*b*, respectively. Under this condition, the drive devices 32*a* and 32*b*** are operated to move the screws axially at the same speed or at the speed with which the injections are achieved at the same time, so that the metal materials are injected into the clamped metal mold. After the metal material is cooled and solidified in the mold, the latter is opened to take the molding out of it. Thereafter, the above-described molding operation is repeatedly carried out as the case may be.

For inspection and maintenance of the injecting units **30*a* and 30*b*, first as shown in FIG. 1, a pressurized fluid is supplied to the fluid cylinder 4, to greatly swing the swing board 10 thereby to cause the injecting nozzles 37*a* and 37*b* of the injecting devices 30*a* and 30*b* to lay beside the second bed section 1*b***. With the nozzles set this way, the inspection and maintenance of the injection units can be achieved with ease.

As was described above, with the injection molding machine of the invention, a solid-phase low-melting-point metal material is supplied into the cylinder barrels of the injecting units, and the external heat, and the frictional heat and shearing heat generated when the screw 5 are turned are utilized to melt and measure the metal material. The screws are driven axially, to inject the metal material into the metal mold, thereby to form a low-melting-point metal molding. In the injecting molding machine, two invention injective units are employed, and in each of the injecting units, the low-melting-point metal material is measured up to a predetermined value. The metal materials thus measured are injected into one cavity from the injecting units. Hence, in the metal mold, the runner is relatively short; therefore the injection molding machine of the present invention is much higher in moldability than a conventional one. Furthermore, the feature that the runner is short improves the manufacturing yeild of the molding process. In other words, low-melting-point metal moldings can be manufactured at low cost. Those effects or merits should be highly appreciated being peculiar to the invention.

In the injection molding device of the present invention, the injecting-unit supporting stands are fixedly mounted on the swing member which is swingable about its swing pin. Hence, the machine has the following characteristics in addition to the above-described effects: By swinging the pair of injecting units mounted on the injecting-unit supporting stands a small amount, the injecting nozzles can be aligned with the nozzle inserting holes, respectively. On the other hand, by swinging the pair of injecting units a large amount, the inspection and maintenance of the latter can be achieved with ease.

What is claimed is:

1. A method of injection-molding a low-melting-point metal material comprising the steps of:

melting a solid low-melting-point metal material in each cylinder barrel of a pair of injecting units by using heat which is externally applied thereto, and frictional heat and shearing heat which are produced when a screw in each of said cylinder barrels is rotated, said pair of injecting units communicating with a single mold cavity via sprues;

measuring said molten solid low-melting-point metal in each of said pair of said injecting units up to a predetermined quantity;

driving said screw of each of said cylinder barrels in an axial direction to inject said low-melting-point metal material into said cavity.

2. A method of injection-molding a low-melting-point metal material as claimed in claim 1, wherein said low-melting-point metal material is a metal element having a melting point of 650° C. or lower or an alloy containing at least one metal element having a melting point of 650° C. or lower.

3. A method of injection-molding a low-melting-point metal material as claimed in claim 2, wherein a sum of the volumes of said low-melting-point metal materials measured by said two injecting units (30*a* and 30*b*) is at least 5000 cc.

4. A method of injection-molding a low-melting-point metal material as claimed in claim 1, wherein a sum of the volumes of said low-melting-point metal materials measured by said two injecting units (30*a* and 30*b*) is at least 5000 cc.

5. An injection molding machine comprising:

a pair of injecting units, each of said injecting units including:

a cylinder barrel having an injecting nozzle at the front end thereof;

a screw disposed in said cylinder barrel such that said screw is rotatable and axially drivable;

driving means for rotating and axially driving said screw;

a stationary board having nozzle inserting holes for receiving said injecting nozzles; and injecting-unit supporting stands for mounting said pair of injecting units parallel to each other, said injecting-unit supporting stands being movable towards and away from said stationary board.

6. An injection molding machine as claimed in claim 5, further comprising:

a metal mold having a cavity communicable with said nozzle inserting holes formed in said stationary board through at least two sprues.

7. An injection molding machine as claimed in claim 5, further comprising:

a swing member on which said injecting-unit supporting stands are fixedly mounted, said swing member being swingable about a swing pin thereof.

* * * * *